United States Patent [19]

Levine

[11] 3,954,577

[45] May 4, 1976

[54] ELECTROCHEMICAL PREPARATION OF ALUMINUM BROMIDE

[75] Inventor: Stephen A. Levine, Fishkill, N.Y.

[73] Assignee: Texaco Inc., New York, N.Y.

[22] Filed: Nov. 27, 1974

[21] Appl. No.: 527,736

[52] U.S. Cl. ..... 204/59 R; 204/94

[51] Int. Cl.[2] ..... C25B 1/24

[58] Field of Search ..... 204/59 R, 59 QM, 94; 423/495

[56] References Cited

UNITED STATES PATENTS

| | | | |
|---|---|---|---|
| 3,113,911 | 12/1963 | Jones | 204/94 |
| 3,240,687 | 3/1966 | Konig et al. | 204/94 |
| 3,330,746 | 7/1967 | Inoue | 204/59 R |
| 3,347,761 | 10/1967 | Bicek | 423/495 |

*Primary Examiner*—T. Tung

*Attorney, Agent, or Firm*—T. H. Whaley; C. G. Ries; George J. Darsa

[57] ABSTRACT

Aluminum bromide is prepared by an electrochemical process in a cell with an aluminum anode, employing as the electrolyte, a solution of hydrogen bromide in an aprotic solvent capable of dissolving both hydrogen bromide and aluminum bromide. After initiation of the reaction with an electric current, the reaction proceeds without additional electrical power. The product is a solution of aluminum bromide and may also include solid aluminum bromide if the amount produced exceeds the solubility limit of the solvent.

16 Claims, No Drawings

ELECTROCHEMICAL PREPARATION OF ALUMINUM BROMIDE

BACKGROUND OF THE INVENTION

Aluminum bromide in relatively pure state is useful as a catalyst in, for example, polymerization and alkylation processes. The compound, unfortunately, possesses certain characteristics which make its preparation and storage in large quantities unfeasible from a commercial and safety standpoint. It is readily decomposed by moisture, liberating fumes of hydrogen bromide. It reacts with water with explosive violence, evolving a great amount of heat. Storage of aluminum bromide is normally in sealed containers under dry inert gas, but there are nevertheless certain disadvantages arising from storage even under the best of conditions. First, there is difficulty in handling the compound because it usually forms lumps and must be ground down to a powder in a dry box prior to dissolving it for use. Secondly, if the entire container of aluminum bromide is not used at one time, successive uses will involve material of lower activity (i.e. less pure $AlBr_3$) owing to its reaction with traces of moisture upon handling. Thirdly, persons who must handle aluminum bromide may be exposed to a potential health hazard. Since, in general, only relatively small amounts of aluminum bromide are needed at any one time, preparation of large amounts of the compound is not commercially convenient. Thus, the economic advantages flowing from techniques for producing large amounts of chemical products have not been available for aluminum bromide of high purity.

The generally used commercial method for preparing aluminum bromide involves treating aluminum with bromine and then distilling the product. This process requires extensive and elaborate equipment and is quite expensive to operate, particularly when only small amounts of the product are desired.

It is, therefore, a principal object of this invention to develop a method for preparing aluminum bromide which is economically attractive when the compound is to be prepared in small quantities. It is another object to develop a method for preparing aluminum bromide in somewhat larger quantities which can be stored in a readily available state without loss of activity resulting from successive uses.

It is a further object of this invention to provide a rapid process for preparing aluminum bromide from starting materials which are readily available. Other objects and advantages will become apparent from the following description of the invention.

SUMMARY OF THE INVENTION

This invention provides an electrolytic process for the preparation of aluminum bromide in an electrochemical cell having a consumable aluminum metal anode and an electrolyte consisting essentially of hydrogen bromide in an appropriate solvent. The solvent is one which is capable of dissolving both hydrogen bromide and aluminum bromide. The reaction is initiated by passing an electric current through the cell. After initiation of the reaction, it proceeds without additional electric power. There is obtained a solution of aluminum bromide which can be separated when required. The preferred solvent is an aprotic solvent boiling above about 25° C and capable of dissolving at least 5% by weight of hydrogen bromide, such as dimethylformamide.

DETAILED DESCRIPTION OF THE INVENTION

The electrochemical process of this invention employs an electrochemical cell, preferably glass lined and a consumable aluminum electrode. As the electrolyte, there is employed a solution of hydrogen bromide, preferably a saturated solution, in a solvent which acts as a solvent both for the hydrogen bromide and the aluminum bromide product. As the counter-electrode, any material which will conduct electricity and not be attacked by hydrogen bromide, bromine or aluminum bromide may be employed.

The aluminum electrode is preferably made of substantially pure aluminum. However, certain metallic and non-metallic impurities may be permitted in this electrode so long as these criteria are met: (1) the electrode must be capable of acting as both a cathode and an anode in the activating solvent system; (2) the impurities must not decrease the activity of the product aluminum bromide, when compared to the activity of aluminum bromide produced by the process of this invention employing a pure aluminum electrode; and (3) the aluminum content of the electrode should be 90% or greater, by weight, and in no case should be less than 60% by weight. Permissible impurities include, but are not limited to, oxygen, nitrogen, sulfur, carbon and silicon in total amounts not exceeding 40%, preferably not exceeding 10% by weight.

Suitable solvents are aprotic solvents, i.e. those not possessing labile protons, which have boiling points above 25°C, and are capable of dissolving hydrogen bromide in an amount at least 5% by weight. Examples of such solvents include acetonitrile, N,N-dimethylacetamide, dimethylformamide, n-hexane, chloroform, cyclohexane, mapthenic hydrocarbons, nitrobenzene, benzonitrile and aromatic hydrocarbons such as benzene, toluene and xylene. Preferred solvents are cyclohexane and dimethylformamide, particularly dimethylformamide.

The counter electrode, i.e. the non-aluminum electrode, may be of any material which will conduct electricity and preferably not be attacked by hydrogen bromide, aluminum bromide, bromine or by-products resulting from any impurities in the aluminum electrode. Materials which are attacked to a limited degree by the aforementioned substances can be employed but yields and quality of the aluminum bromide product would be expected to suffer. Platinum is preferred for this electrode, but other inert materials such as palladium, iridium, rhenium, graphite and glassy carbon may also be used.

The process of this invention may be run over a wide range of temperature and pressure conditions. Temperatures may range from about 0° to about 150°C, with a range of 12° to 35°C being especially convenient. Pressures can range from atmospheric to about 150 psig, with pressures below 50 psig being preferred.

Because of the instability of aluminum bromide in water, water should be excluded to the extent possible. The amount of water present should be below 100 ppm, preferably below 10 ppm.

Since pure metallic aluminum, hydrogen bromide and solvents such as dimethylformamide and cyclohexane are readily available, the process of this invention provides a readily available method of preparing aluminum bromide. The aluminum bromide can, if desired, be prepared in small quantities. Relatively large amounts of product can also be obtained according to the process of this invention because the aluminum bromide will be produced as long as there is hydrogen bromide in the solvent even though the solubility of the aluminum bromide in the solvent is exceeded. The aluminum bromide product can be separated from the solvent by methods well known in the art. Thus, any solid product can be isolated by filtration. The filtration step need not be performed, however, until the aluminum bromide is needed for use and then only so much as is immediately necessary need be recovered. For example, when N,N-dimethylformamide is used as the solvent, it will contain, after the process of this invention has been completed, about 5% by weight of dissolved aluminum bromide. The remainder of the product is precipitated in solid form, protected from moisture and readily available for use when needed. The amount of aluminum bromide dissolved will, of course, depend on the solvent employed. The dissolved product can be separated, if desired, by other well known methods, such as distillation.

According to one embodiment of this invention a saturated solution of hydrogen bromide in a conducting solvent, is introduced into an electrochemical cell having metallic aluminum as the anode and a suitable cathode. Conducting solvents include dimethylformamide, acetonitrile. The N,N-dimethylacetamide, nitrobenzene and benzonitrile. The reaction is initiated by means of an electric current. Once a reactive surface has formed on the aluminum anode, the current is turned off and the reaction is allowed to proceed. Generally, the reaction will proceed without the use of additional current. However, the anode surface may have to be reactivated periodically, but the amount of current required is minimal.

In another, less preferred, embodiment, the solvent is a non-conducting solvent, such as cyclohexane. The aluminum anode is activated with a conducting solvent containing hydrogen bromide. This conducting solvent is then removed from the cell and replaced by the non-conducting solvent and the reaction allowed to continue to completion.

According to a preferred embodiment of this invention, there is employed an aluminum electrode and a platinum counter electrode. The aluminum is first made the cathode and an electric current is passed through the cell in order to reduce any aluminum oxide which may be on the surface of the aluminum. During this step, there will be generated some bromine at the platinum anode; this bromine will react later with the aluminum. The polarity of the electrodes is then reversed and the aluminum electrode becomes the anode. Again, an electric current is passed through the cell to initiate the reaction, which proceeds in the manner described above.

The reaction which occurs at the aluminum anode is:

$$6HBr + 2\ Al^{\circ} \rightarrow Al_2Br_6 + 3\ H_2$$

The by-product hydrogen may be collected and utilized according to procedures well-known in the art.

Although the process of this invention has been described above as a batch operation, it may also be run as a continuous process. To operate as a continuous process, the cell is fitted with a glass-lined pipe running from the bottom of the cell outside the cell to a point near its top. This pipe thus forms a loop and said loop is fitted with means, e.g. a valve, to draw off a portion of the liquid stream containing dissolved aluminum bromide and precipitated aluminum bromide. Other valves are provided near the top of the loop for the addition of make-up solvent and hydrogen bromide.

This invention will be better understood by reference to the following examples which are here included for the purpose of illustration only and are not intended as limitations.

EXAMPLE 1

A glass-lined electrochemical cell was fitted with an aluminum anode having an area of 188.12 $cm^2$ and a platinum wire cathode. The electrolyte comprised 144.5 gms. of hydrogen bromide in 95.5 gms. of dimethylformamide. The temperature was 13°C. The reaction was initiated by passing a current of 0.5 amps through the cell for 9 minutes. The reaction was permitted to proceed for 2.2 hours. The aluminum bromide product was produced in 62 % selectivity and 2 % yield. The yield is based on all of the aluminum electrode introduced and the selectivity is based on that part of the electrode that was consumed. The reaction was not carried to the point of complete consumption of either the aluminum electrode or the hydrogen bromide. The aluminum bromide is recoverable either as the solid or as a solution. In this example, approximately two-thirds of the aluminum bromide was recovered as a solid by simple filtration from the mixture (and then dissolved in additional dimethylformamide for storage). The remainder of the aluminum bromide was dissolved in the filtrate (5 % solution).

EXAMPLE 2

The aluminum bromide precipitate prepared by the method of Example 1 was dissolved in n-hexane to obtain a solution of 5% $AlBr_3$. The aluminum bromide solution is then charged with 1.5 weight percent hydrogen bromide to form the catalyst and fed to a Stratco contactor with a propylene monomer feed (50% w/w propylene) at the propylene/aluminum bromide weight ratio of 189. Reactor temperature is maintained at −5°C and the residence time is 4.5 hours. Polypropylene was obtained in 89% yield based on the weight of the propylene charged.

EXAMPLE 3

To avoid handling, the precipitated aluminum bromide prepared according to Example 1 is not filtered but allowed to settle out in the electrochemical cell. The super-natant dimethylformamide solution is decanted. The solid aluminum bromide is then redissolved in n-hexane and charged with 1.5 weight percent hydrogen bromide to form the catalyst and used according to the method of Example 2.

What is claimed is:

1. An electrolytic process for the preparation of aluminum bromide which comprises providing an electrochemical cell with an aluminum anode, a cathode which is not attacked by hydrogen bromide, aluminum bromide or bromine and an electrolyte consisting essentially of hydrogen bromide in a solvent capable of dissolving hydrogen bromide and aluminum bromide, said electrolyte having below 100 ppm of water, and passing an electric current through the cell in order to initiate a reaction, whereby there is obtained a solution of aluminum bromide.

2. A process according to claim 1 wherein the electrolyte is a solution of hydrogen bromide in an aprotic solvent, said solvent having a boiling point above about 25°C and capable of dissolving at least 5% by weight of hydrogen bromide.

3. A process according to claim 2 in which the electrolyte is a saturated solution of hydrogen bromide.

4. A process according to claim 2 in which the solvent is dimethylformamide.

5. A process according to claim 2 in which the solvent is cyclohexane.

6. A process according to claim 1 in which the aluminum electrode is composed of at least 90% by weight of aluminum.

7. A process according to claim 6 in which the aluminum electrode is composed of substantially pure aluminum.

8. A process according to claim 1 in which the cathode is composed of a material selected from the group consisting of platinum, palladium, rhenium, graphite and glassy carbon.

9. A process according to claim 8 in which the cathode is composed of platinum.

10. An electrolytic process for the preparation of aluminum bromide which comprises providing an electrochemical cell with an aluminum anode composed of at least 90% by weight of aluminum, a cathode which is not attacked by hydrogen bromide, aluminum bromide or bromine, and an electrolyte comprising a solution of 5% or more by weight hydrogen bromide in an aprotic solvent having a boiling point above 25°C., said electrolyte having below 100 ppm of water, and passing an electric current through the cell in order to initiate a reaction, whereby there is obtained a solution of aluminum bromide.

11. A process according to claim 10 in which the electrolyte is a saturated solution of hydrogen bromide.

12. A process according to claim 10 in which there is obtained a saturated solution of aluminum bromide and solid aluminum bromide as product.

13. An electrolytic process for the preparation of aluminum bromide which comprises the steps of (1) providing an electrochemical cell with an aluminum electrode composed of at least 90% by weight of aluminum, a platinum electrode and an electrolyte consisting essentially of at least 5% by weight of hydrogen bromide in an aprotic solvent capable of dissolving hydrogen bromide and aluminum bromide, said electrolyte having below 100 ppm of water, (2) initially making the aluminum electrode the cathode and the platinum electrode the anode, (3) passing an electric current through the cell in order to reduce any aluminum oxide on the surface of the aluminum electrode, (4) reversing the polarity of the electrodes, and (5) passing an electric current through the cell to initiate a reaction, whereby there is obtained a solution of aluminum bromide.

14. A process according to claim 13 wherein the electrolyte is a saturated solution of hydrogen bromide in a aprotic solvent having a boiling point above about 25°C.

15. A process according to claim 14 in which the aluminum electrode is composed of substantially pure aluminum.

16. A process according to claim 14 in which the solvent is dimethylformamide.

* * * * *